United States Patent [19]

Tomita

[11] 4,391,261

[45] Jul. 5, 1983

[54] CARBURETOR ACTUATING SYSTEM FOR V-ENGINES

[75] Inventor: Yoshiaki Tomita, Hamakita, Japan

[73] Assignee: Yamaha Hatsudoki Kabushiki Kaisha, Iwata, Japan

[21] Appl. No.: 283,932

[22] Filed: Jul. 16, 1981

[30] Foreign Application Priority Data

Jul. 8, 1980 [JP] Japan ..... 55-107649

[51] Int. Cl.[3] ..... F02B 13/00

[52] U.S. Cl. ..... 123/584; 123/52 MV; 261/23 A

[58] Field of Search ..... 123/583, 336, 584, 59 PC, 123/52 MV; 261/23 A

[56] References Cited

U.S. PATENT DOCUMENTS

| | | | |
|---|---|---|---|
| 2,421,800 | 6/1947 | Martin | 123/583 |
| 2,681,213 | 6/1954 | Gordon | 123/583 |
| 2,766,743 | 10/1956 | Platner et al. | 123/584 |
| 3,328,007 | 6/1967 | Bickhaus et al. | 123/583 |
| 4,062,334 | 12/1977 | Toda et al. | 123/583 |

*Primary Examiner*—Craig R. Feinberg
*Assistant Examiner*—E. Rollins Gross
*Attorney, Agent, or Firm*—Freilich, Hornbaker, Wasserman, Rosen & Fernandez

[57] ABSTRACT

A carburetor actuating system for two carburetors (5*a*, 5*b*) in V-shaped space (4) between two cylinders (2*a*, 2*b*) of a V-engine such that drafting directions of the respective carburetors are opposite to each other. One carburetor (5*b*) is controlled by a cable (16*b*) attached to an actuating arm (15*b*) connected to the valve stem (14*b*) protruding to the outside of the one carburetor (5*b*), i.e., in a direction away from the carburetor. The other carburetor (5*a*) is controlled by a driven arm (21*a*) connected to the valve stem (14*a*) protruding toward the carburetor (5*b*). The driven arm is actuated by a drive arm (21*b*) connected to the valve stem of the one carburetor (5*a*) through links (22*a*, 22*b*) hinged by a pin (24) constrained by a guide groove (28) to motion along a perpendicular bisector of a line passing through the axes of the valve stems (14*a*, 14*b*). The link (22*a*) for the driven arm (21*a*) is connected to it through a lever arm (21*c*) loosely connected to the valve stem (14*a*) adjusted in position relative to the driven arm by bolt (21*e*) to adjust the phase of the other carburetor (5*a*) relative to the one carburetor (5*b*) controlled by the cable (16*b*).

8 Claims, 6 Drawing Figures

CARBURETOR ACTUATING SYSTEM FOR V-ENGINES

BACKGROUND OF THE INVENTION

The present invention relates to an actuating system for controlling the carburetor of an internal combustion engine, and more particularly to a dual carburetor system for a V-engine in which carburetors for the cylinders are positioned side by side in a V-shaped space between the cylinders, and in which the valve stems of the throttle valves for the cylinders are rotated simultaneously to open and close the throttle valves of the carburetors in unison.

In a V-engine, generally speaking, it is customary for a caburetor to be positioned in the V-shaped space between cylinders so as to make the external shape of the V-engine compact, such as in a motorcycle. According to this positioning, a V-shaped engine is equipped with a separate carburetor for the cylinders on each side with the drafting directions of the respective caburetors opposite to each other. Therefore, if the respective caburetors used are to have the same specifications, it becomes necessary to make their throttle valve stems so coactive that they are rotated in opposite directions. In other words, if the same carburetor design is to be used for both sides of the V-engine, one must be turned 180° so that its valve stems must rotate in a direction opposite to the other. That then presents a problem in rotating both valve stems in unison.

This problem has been solved according to the prior art by providing a separate throttle-actuating cable for each carburetor and connecting both to the same control member, such as the accelerating grip of a motorcycle. However, the throttle cables of the respective carburetors tend to stretch differently so that in time the output power of the respective cylinders become unequal thereby causing undesirable engine vibration and interference between cylinders in engine exhaust operation. It is therefore necessary for the coactions of the throttle valve stems to be ensured by means of a linkage.

The present invention has been conceived in view of the requirement for dual carburetors thus far described, and has as an object to make such a dual carburetor as compact as possible, yet capable of being assembled, and operated reliably without any difference between caburetors even though there is significant offset between the throttle valve stems of the carburetors.

SUMMARY OF THE INVENTION

In accordance with the present invention, dual carburetors of a V-engine are arranged side by side in the V-shaped space between engine cylinders with the drafting directions of the carburetors to cylinders of the V-engine opposite to each other and inclined downwardly such that in operation the throttle valve stems are to be rotated in opposite directions. A throttle cable attached at one end to a throttle control member is connected at the other end to an actuating arm attached to the valve stem on the outside of one throttle valve stem for opening the valve when the cable is pulled. A spring returns the valve stem to the closed position when the cable is allowed, or caused, to return to its initial throttle closed position. At the other end of the valve stem there is attached a drive arm which actuates a linkage for pivoting a driven arm attached to the end of the valve stem of the other carburetor. The linkage is comprised of a first link hinged at the end of the drive arm and a second link hinged by a pin at the end of the first link. The hinge between the two links is constrained to move in a guide along a line that is a perpendicular bisector of a line between the axes of the valve stems of the two carburetors. The second link is connected to the driven arm of the valve stem for the second carburetor by a lever arm which is loosely connected to the valve stem of the second carburetor. Means, in the form of a bolt and spring, are provided for adjusting the position of the driven arm relative to the lever arm, thereby to adjust the phase of the second carburetor valve stem relative to the valve stem of the first carburetor.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
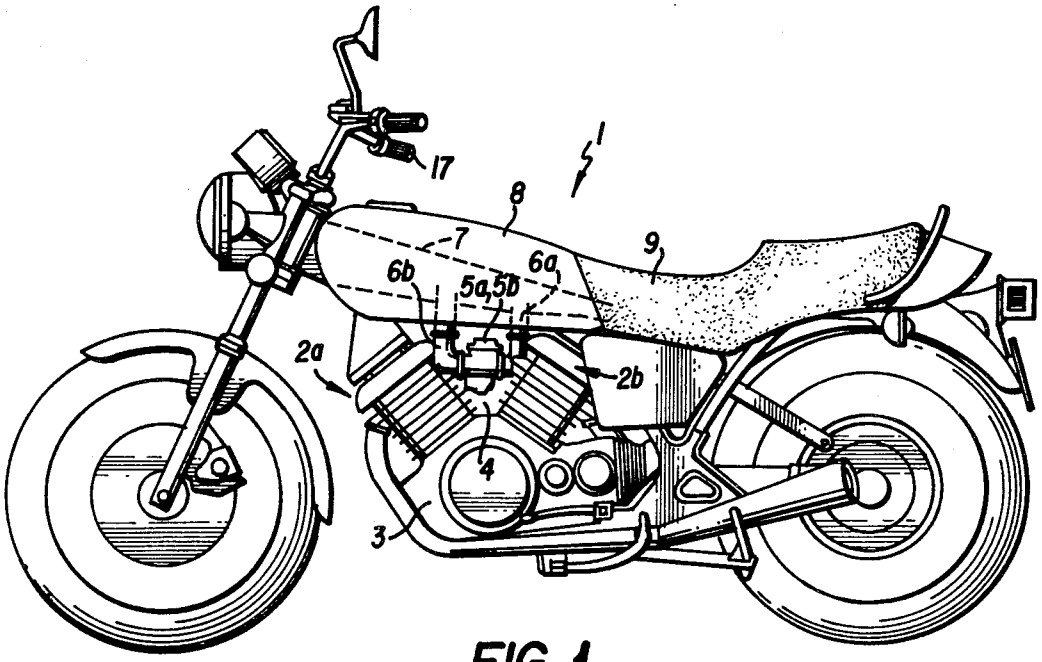
FIG. 1 is a side elevation showing a motorcycle with a V-engine and dual carburetors arranged in the V-shaped space between cylinders.

Referring now to FIG. 1 of the drawings, a motorcycle 1 is shown with a V-engine having front and rear cylinders 2*a* and 2*b* for powering an engine 3. In a V-shaped space 4 between the cylinders, there are mounted a first carburetor 5*a* communicating with the front cylinder and a second carburetor 5*b* communicating with the rear cylinder 2*b*. Intake pipes 6*a* and 6*b* of the front and rear cylinders 2*a* and 2*b* open into a frame 7 (shown in broken lines). The intake pipe 6*a* on the far side of the motorcycle extends backward from the front cylinder through the carburetor 5*a* to the frame 7, and the intake pipe 6*b* on the near side of the motorcycle extends forward from the rear cylinder through the carburetor 5*b* to the frame 7. Both intake pipes are bent upward after leaving the carburetors to communicate with the frame 7.

The frame 7 is a shell constructed by securing together right and left halves, which halves are press-molded of a steel plate and welded along the peripheral edges of the halves. The frame 7 thus constructed has its rear end open to communicate with the atmosphere through an air filter (not shown). Numerals 8 and 9 indicate a fuel tank and a rider's seat, respectively.

Figure 2:
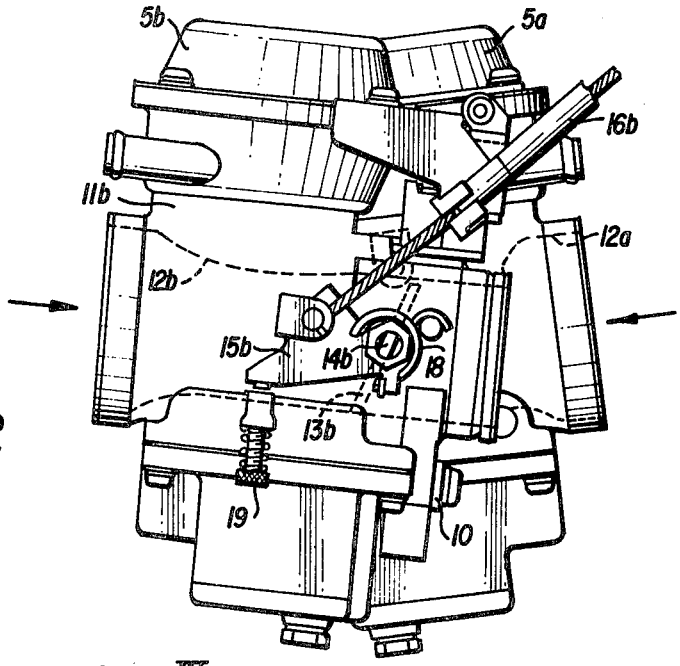
FIG. 2 is an enlarged side elevation showing the two carburetors coactively arranged in accordance with the present invention in the V-shaped space of the motorcycle engine shown in FIG. 1.
Figure 3:
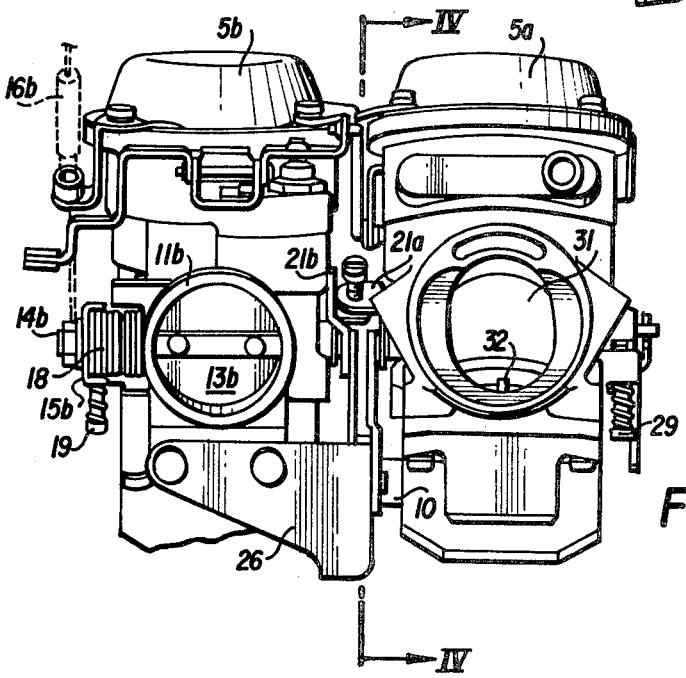
FIG. 3 is a front elevation showing the two carburetors of FIG. 2 as seen from the rear of the motorcycle.

The carburetors 5*a* and 5*b* are made to have generally the same external shape and are connected by means of a frame member 10 shown in FIGS. 2 and 3 such that their drafting directions (as indicated by arrows in FIG. 2) are opposite to each other and inclined downwardly toward the front and rear cylinders 2*a* and 2*b*.

The constructions of the carburetors 5a and 5b will now be described with references to FIGS. 2–6. Located at the near side of FIG. 2 is the second carburetor 5b which has its intake barrel 11b equipped with an intake passage 12b and a butterfly-type manual throttle valve 13b (indicated by broken lines). This throttle valve 13b is supported on a throttle valve stem 14b in a well-known manner.

In this exemplary embodiment, the carburetors 5a and 5b are of the so-called "vacuum responding type" which is one equipped with a piston-type automatic valve in addition to the manual throttle valve 13b. The automatic valve is made responsive to the venturi vacuum so that it is opened when the venturi vacuum is high (i.e., the absolute pressure value is low).

The throttle valve stem 14b has one end (the near end in FIG. 2) protruding from the intake barrel 11b to the outside, and secured to this protruding end is a throttle lever and an actuating arm 15b. A Boden cable 16b connects the free end of this actuating arm 15b, to a throttle grip 17 shown in FIG. 1, or other control member. A return spring 18 restores the throttle valve 13b to its closed position when the cable is restored to its initial valve-closed position, and a stop screw 19 adjusts the minimum closing of the throttle valve 13b to set the idling speed of the motor.

The other end of the throttle valve stem 14b, which is the far end in FIG. 2 and the right hand end in FIG. 3, is made to protrude from the intake barrel 11b toward the first carburetor 5a. A drive arm 21b has its pivoted end attached to this far end protruding portion of the throttle valve stem 14b. As the cable 16b is pulled by the throttle grip to open the throttle valve 13b, the drive arm 21b is pivoted to simultaneously actuate a driven arm 21a connected to the valve stem 14a of the carburetor 5a through a linkage, thereby to open the throttle valve 13a of the first carburetor 5a in the opposite direction.

The manner in which this drive arm 21b is connected to a driven throttle control arm 21a of carburetor 5a by a linkage will now be described with reference to FIG. 4. The driven arm 21a is rigidly connected to the throttle valve stem 14a. Another arm 21c is loosely attached to the valve stem 14a. Arms 21a and 21c are urged to rotate apart by a spring 21d to an extent limited by means of a bolt 21e so that the relative phases of the throttle valves can be adjusted.

Figure 5:
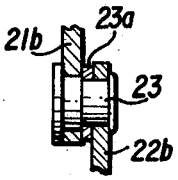
FIG. 5 is a section taken along a line V—V of FIG. 4.
Figure 6:
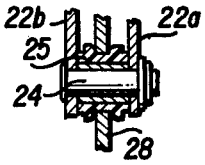
FIG. 6 is a section taken along a line VI—VI of FIG. 4.

The linkage between the arms 21a and 21b is comprised of a first connecting link 22a, which has one end hinged to the lever arm 21c, and a second connecting line 22b which has one end hinged to the drive arm 21b. FIG. 5 shows the manner in which the drive arm 21b and the link 22b are hinged together by means of a pin 23 with washer 23a between them so that they are free to pivot, one with respect to the other. The connecting links 22a and 22b are hinged together in the manner shown in FIG. 6 by means of a pin 24. A guide roller 25 is secured between the links by the pin 24.

Figure 4:
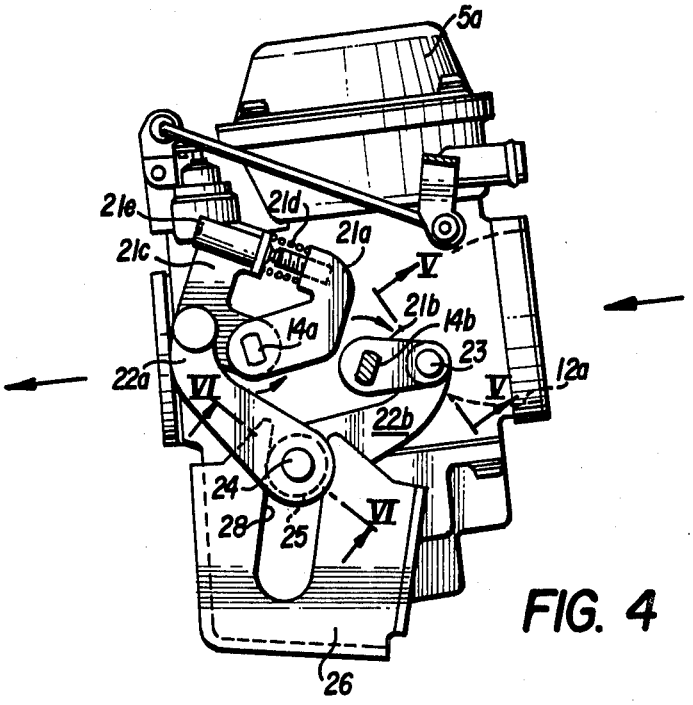
FIG. 4 is a section taken along a line IV—IV of FIG. 3.

Numeral 26 in FIGS. 3 and 4 indicates a bracket which is secured by screws to the intake barrel 11b of the second carburetor 5b. The guide member 26 is press-molded of a steel plate and is formed with a guide groove 28 at its center portion as shown in FIG. 4. This guide groove 28 constrains the up and down motion of the pin 24 and roller 25 that hinges the links 22a and 22b.

After the aforementioned respective arms 21a and 21b and connecting links 22a and 22b have been connected, the guide groove 28 is brought into engagement with the guide roller 25, and the bracket 26 is fixed by means of screws to the intake barrel 11b, thereby to restrict motion of the pin 24 and roller 25 hinging the aforementioned links 22a and 22b along the perpendicular bisector of a line between the axes of the throttle valve stems 14a and 14b. When the cable 16b pulls the actuating arm 15b (FIG. 2) to open the throttle valve of carburetor 5b, it rotates the valve stem 14b clockwise, which in turn pivots the drive arm 21b (FIG. 4) clockwise, forcing the pin 24 and guide roller 25 down the groove 28. Consequently the downwardly moving link 22a pulls the lever arm 21c counterclockwise. That in turn pulls the driven arm 21a counterclockwise. This turns the valve stem 14a in a direction opposite to the valve stem 14b, as required by the fact that carburetor 5a is turned 180° with respect to the carburetor 5b. It is thus evident that opening the butterfly-type valve 13b of the carburetor 5b clockwise (as viewed in FIG. 2) will also open the butterfly-type valve of the carburetor 5a in the opposite direction, namely counterclockwise as viewed in FIG. 2 or 4. The phase of the butterfly-type valve for the carburetor 5a relative to the butterfly-type valve of the caburetor 5b is easily adjusted by turning the bolt 21e which adjusts the position of the driven arm 21a relative to the lever arm which is in turn controlled as to its position by the links 22a and 22b according to the position of the driven arm 21b.

Numeral 29 in FIG. 3 indicates the stop screw of the first carburetor 5a. Numerals 31 and 32 indicate a piston-type automatic valve for the aforementioned vacuum operation and a needle valve mounted in the automatic valve 31 for metering the flow rate of a fuel.

In summary, if the control member 17 (FIG. 1) is turned to open the throttle valves, thereby to increase the output power of the engine, the actuating arm 15b of carburetor 5b is swung clockwise through the Boden cable 16b so that the throttle valve stem 14b turns clockwise to increase the opening of the butterfly-type valve 13b. Since the drive arm 21b (FIG. 4) is fixed to the throttle valve stem 14b, it is simultaneously pivoted to push the connecting link 22b. Because the other end of the connecting link 22b supports the pin 24 on which the guide roller 25 is loosely fitted, the guide roller 25 guides the pin 24 downwardly along the guide groove 28 until the pin 24 reaches the bottom of the groove as its maximum stroke. Then, the other connecting link 22a, to which the pin 24 is hinged, is pulled downwardly to pivot the driven arm 21a counterclockwise to turn the throttle valve stem 14a counterclockwise. As a result, the opening of the throttle valves of the two carburetors are opened simultaneously by the same amount, with the actual position of the throttle valve of the carburetor 5b relative to the throttle valve of the carburetor 5a set by the bolt 21e.

Since the present invention is characterized in that the carburetors are positioned between at least two cylinders arranged in the V-shaped space between the cylinders; in that the throttle valve stems of the carburetors are made to protrude toward each other; in that the drive arm and the driven arm are fixed to the protrusions of the valve stems of the two carburetors; in that the drive arm is connected to the driven arm by means of the connecting links which are hinged to each other; and in that the hinge of the links is constrained to motion along a perpendicular bisector of a line passing through the axes of the valve stems of the two carburetors; there can be attained an advantage that the phases of the two valve stems can be preset by means of the bolt 21*e* notwithstanding that the distance between the throttle valve stems of the respective carburetors is not accurate. Moreover, since the drive arm, the driven arm and the first and second connecting links are not restricted until the guide pin and roller are attached, another advantage is that the respective carburetors can be easily assembled with their respective links. Moreover, since the mechanism, such as the guide roller and the connecting links, are mounted in the space between the respective carburetors, a further advantage is that the total caburetor package is not enlarged, but is instead made compact.

Although particular embodiments of the invention have been described and illustrated herein, it is recognized that modifications and variations may readily occur to those skilled in the art. Consequently, it is intended that the claims be interpreted to cover such modifications and equivalents.

What is claimed is:

1. A dual carburetor system for a V-engine utilizing two carburetors, each having a throttle valve stem protruding through at least one side, the protruding valve stem of one having connected to it a drive arm, and the protruding valve stem of the other having connected to it a driven arm, characterized in that the carburetors are positioned side by side in the V-shaped space between two engine cylinders with said valve stems having said drive arm and driven arm fixed thereto protruding toward each other; said drive arm being connected to said driven arm by means of two connecting links hinged to the respective drive and driven arms at one end of each and hinged to each other at their other ends; and a slot in a plate between the carburetors to constrain motion of said hinge between the links along a perpendicular bisector of a line passing through the axes of the protruding valve stems of the two carburetors.

2. A dual carburetor system as defined in claim 1 wherein the phases of the two valve stems are preset by means which adjusts the position of one link relative to the one arm to which it is hinged.

3. A dual carburetor system as defined in claim 2 wherein the one arm adjusted in phase is the driven arm, and said means is comprised of a lever arm loosely connected to the valve stem to which said driven arm is connected, said lever arm being connected at its end to the end of said driven arm by a bolt, and the ends of said lever arm and said driven arm are forced apart by a spring to an extent permitted by said bolt, whereby drawing the ends of said driven and lever arms toward each other with said bolt against the force of said spring adjusts the phase of the valve stem to what said driven arm is connected relative to the valve stem to which said drive arm is connected.

4. In a dual carburetor for a V-engine having at least two cylinders arranged in the shape of a letter "V", in which a first caburetor communicating with one of the cylinders and a second carburetor communicating with the other cylinder are arranged side by side between the two cylinders such that their drafting directions are opposite to each other, the combination comprising throttle valves turning in opposite directions in said first and second carburetors on valve stems protruding toward each other from said first and second carburetors, a drive arm fixed to the protruding valve stem of said first carburetor, a driven arm fixed to the protruding valve stem of said second carburetor, and a linkage connecting said drive arm to said driven arm, said linkage being comprised of a link connected to said drive arm, a link connected to said driven arm, a pin hinging the free ends of said links together, and means for constraining the hinged ends of said links to motion along a fixed path, whereby opening the throttle valve of said first carburetor will cause the throttle valve of said second carburetor to open correspondingly.

5. A dual carburetor actuating system as defined in claim 4 wherein said second link is connected to said driven arm by a lever arm loosely connected to the protruding valve stem, and means for adjustably spacing the end of said lever arm with respect to said driven arm to adjust the phase of said valve stem of said second carburetor with respect to the valve stem of said first carburetor, and said second link is hinged from said lever arm.

6. A dual carburetor actuating system as defined in claim 4 or 5 wherein said means for constraining the hinged ends of said link is comprised of a roller on said pin between the hinged ends of said links and a groove in a plate between said carburetors for guiding said roller, said groove having its center line perpendicular to a line passing through the center lines of said valve stems.

7. A dual carburetor actuating means as defined in claim 6 wherein said means for adjustably spacing the end of said lever arm with respect to said driven arm is comprised of a spring separating said lever arm and said driven arm, and a bolt passing loosely through one of said lever and driven arms and threaded into the other to draw the arms together against the force of said spring.

8. In a dual carburetor for an internal combustion engine having at least two cylinders arranged in the shape of a letter "V", in which a first carburetor communiating with one of the two cylinders and a second carburetor communicating with the other cylinder are positioned side by side between the two cylinders such that their drafting directions are opposite to each other, a carburetor actuating system for simultaneously opening and closing throttle valves in unison by turning valve stems protruding from said first and second carburetors towards each other, said actuating system comprising means for turning said valve stem of said first carburetor in one direction for opening the throttle valve of said first caburetor, a driven arm connected to said valve stem protruding from said first carburetor, a link hinged at the end of said drive arm, a driven arm connected to said valve stem protruding from said second carburetor, a lever arm loosely connected to said protruding valve stem of said second carburetor, means for adjustably spacing the end of said lever arm from the end of said driven arm, a link hinged from said lever arm, means for hinging the free ends of said links to each other, and means for constraining said free ends of said links hinged together to motion along a perpendicular bisector of a line through the axes of said valve stems of said first and second carburetors.

* * * * *